United States Patent [19]

Cho

[11] 4,097,973

[45] Jul. 4, 1978

[54] APPARATUS FOR UNFOLDING, SPREADING AND GUIDING TRAVELLING FABRIC

[76] Inventor: Hideyuki Cho, 5-6-4, Takanodai, Suita-shi, Osaka-fu, Japan

[21] Appl. No.: 810,722

[22] Filed: Jun. 28, 1977

[51] Int. Cl.[2] ..... D06C 3/06

[52] U.S. Cl. ..... 26/78; 26/97; 26/98

[58] Field of Search ..... 26/75, 78, 97, 98

[56] References Cited

U.S. PATENT DOCUMENTS

| | | | |
|---|---|---|---|
| 2,639,483 | 5/1953 | Wester | 26/75 X |
| 3,414,954 | 12/1968 | Alexeff | 26/75 |
| 3,822,448 | 7/1974 | Cho | 26/75 X |

FOREIGN PATENT DOCUMENTS

| | | | |
|---|---|---|---|
| 1,061,279 | 7/1959 | Fed. Rep. of Germany | 26/97 |
| 2,235,418 | 2/1973 | Fed. Rep. of Germany | 26/97 |
| 2,558,162 | 7/1976 | Fed. Rep. of Germany | 26/75 |
| 4,528,031 | 9/1970 | Japan | 26/97 |
| 145,536 | 1962 | U.S.S.R. | 26/75 |

*Primary Examiner*—Robert R. Mackey

*Attorney, Agent, or Firm*—Larson, Taylor and Hinds

[57] ABSTRACT

An apparatus comprises guide means including a stationary roller and a movable roller opposed to the stationary roller and movable toward or away therefrom to nip a selvage of the fabric between the rollers when required to correct deviation of the fabric, and unfolding and spreading means including at least three screw rollers arranged side by side at the feed side of the guide means and along the direction of travel of the fabric. Each of the screw rollers is rotatable by a motor in the direction of unfolding and spreading the fabric, at least one of the screw rollers other than the screw rollers at the opposite sides thereof being pivotally movable toward or away from the surface of the fabric. The stationary roller of the guide means includes a roller main body and a shaft rotatable by the motor in the same direction as the direction of travel of the fabric. A friction member having suitable frictional resistance is provided between the shaft and the stationary roller main body to render the stationary roller main body rotatable by the motor when the movable roller is away from the stationary roller. When a selvage sensor detects inward deviation of the selvage, the movable guide roller is brought into contact with the stationary guide roller to nip the selvage for the correction of the deviation and, at the same time, the pivotally movable screw roller is brought into the space between the other two screw rollers to cause the fabric to contact the screw rollers over increased areas with an increase force to give an enhanced unfolding and spreading effect.

9 Claims, 5 Drawing Figures

APPARATUS FOR UNFOLDING, SPREADING AND GUIDING TRAVELLING FABRIC

The present invention relates to improvements in an apparatus for unfolding, spreading and guiding a woven, nonwoven or knitted fabric strip and more particularly to an apparatus for correcting shrinkage, creasing, folding, deviation of such fabric and turnups of its selvage while the fabric is being travelled for rewinding, dyeing or some other treatment so as to ensure the treatment properly.

Various apparatus of this type have heretofore been developed and used which include those adapted only to unfold and spread a travelling fabric, those designed solely for guiding a fabric for the correction of deviation of the fabric and further those comprising unfolding means and guide means in combination.

With such known apparatus, the unfolding and spreading apparatus is adapted to nip the selvage of the fabric with two correcting members for unfolding and spreading only when a turnup occurs in the selvage or the fabric creases, so that it is difficult to unfold the turnup or spread the fabric smoothly with good timing in a continuous manner. The guide apparatus comprises a pair of freely rotatable rollers which are movable toward or away from each other, or a pair of rollers only one of which is freely rotatable, the other roller being positively rotatable by a motor in the same direction as the direction of travel of the fabric. With such construction, the two rollers operate in such manner that when the travelling fabric deviates away from the rollers, the rollers are brought into contact with each other to nip the fabric and remedy the deviation. Accordingly the guide apparatus has the following drawbacks. In the case of the former construction in which the pair of rollers are driven only by the force of the travelling fabric, the fabric is subjected to the load required to initiate the rollers into rotation when the rollers come into nipping engagement with the fabric. Thus intense tension acts on the fabric on the discharge side of the rollers, possibly causing damage to the fabric or otherwise adversely affecting the fabric. In the case of the latter construction, one of the rollers must be positively driven by a motor at a surface velocity which is equal to the travelling speed of the fabric. However, it is difficult to maintain such velocity. Consequently, if the surface velocity of the roller is greater than the travelling speed of the fabric, intense tention acting on the fabric on the feed side of the rollers upon the rollers coming into nipping engagement with the fabric tends to damage the fabric, whereas on the discharge side of the rollers the fabric slackens, possibly producing a seriously adverse effect on the operation. Conversely, if the surface velocity of the positively driven roller is lower than the travelling speed of the fabric, high tension acts on the fabric on the discharge side of the rollers and is liable to damage the fabric when the rollers nip the fabric. On the feed side of the rollers, the fabric will then slacken and, if a spreading device is disposed on that side of the rollers, the device fails to give a spreading action or some other serious influence will result.

An object of this invention is to provide an apparatus comprising the combination of unfolding and spreading means and guide means for a travelling woven, nonwoven or knitted fabric, the unfolding and spreading means being operable with greatly improved smoothness in a continuous manner and capable of giving varying degrees of unfolding and spreading effect in accordance with the shrinkage and creasing of the fabric and the turnups of its selvage, the guide means being also very smoothly and efficiently operable for the correction of deviation of the fabric free of any damage to the fabric and slackening thereof.

Another object of this invention is to provide an apparatus of the type described wherein the function of the guide means to correct the deviation of the travelling fabric and the function of the unfolding and spreading means can be augmented automatically upon the deviation of the selvage of the fabric, the two means thus being synergically improved in function so as to contribute a great deal to various treatments of the fabric.

The present invention provides an apparatus for unfolding, spreading and guiding a travelling fabric comprising guide means including a stationary roller and a movable roller opposed to the stationary roller and movable toward or away therefrom to nip a selvage of the fabric between the rollers when required to correct deviation of the fabric, unfolding and spreading means including at least three screw rollers arranged side by side at the feed side of the guide means and along the direction of travel of the fabric, each of the screw rollers being rotatable by a motor in the direction of unfolding and spreading the fabric, at least one of the screw rollers other than the screw rollers at the opposite sides thereof being pivotally movable toward or away from the surface of the fabric when required, the stationary roller of the guide means having a roller main body and a shaft rotatable by the motor in the same direction as the direction of travel of the fabric, a friction member provided between the shaft and the stationary roller main body and having suitable frictional resistance to render the stationary roller main body rotatable by the motor when the movable roller is away from the stationary roller, a selvage sensor disposed for the selvage of the fabric, means for moving the movable guide roller into contact with the stationary guide roller upon the sensor detecting inward deviation of the selvage of the fabric, and shifting means for forcing the movable screw roller into the space between the screw rollers on the opposite sides thereof simultaneously with the contact of the movable roller with the stationary roller upon the sensor detecting the inward deviation of the selvage.

According to this invention, the unfolding, spreading and guiding apparatus is disposed at each of the opposite selvages of a travelling fabric strip. The selvage of the fabric is passed over the screw rollers arranged side by side in such manner that the front and rear surfaces of the fabric are alternately in contact with the roller surface from roller to roller. The fabric is further passed between the stationary guide roller and the movable guide roller and is wound on a take-up roller (not shown). The screw rollers and the stationary roller are driven by a motor.

With the unfolding, spreading and guiding apparatus of this invention having the foregoing construction, the travelling fabric is unfolded and spread at all times by screw grooves in the roller surfaces while passing over the unfolding and spreading screw rollers which are driven by the motor, whereby creasing and shrinkage of the fabric and turnups of its selvage can be corrected. Further when required, the movable screw roller is forced in between the side screw rollers to push the fabric inward, permitting the fabric to contact the screw rollers over increased areas and under a greater pressure, whereby an improved unfolding and spreading effect is attainable. Furthermore, the screw rollers act to eliminate any turnups on the front and rear surfaces of the fabric.

While the apparatus of this invention, the friction member having suitable frictional resistance and provided between the shaft which is positively driven by a motor and the stationary roller main body loosely mounted on the shaft causes the roller main body to rotate with the shaft when the movable roller is away from the stationary roller. When the stationary and the movable rollers remedy the deviation of the fabric in nipping engagement with the travelling fabric, the fabric drives the stationary roller therewith while overcoming the frictional resistance of the friction member, with the result that the rollers will not give any tension to the fabric or slacken the fabric when nipping the fabric. Accordingly, the rollers can remedy the deviation of the fabric very smoothly to properly guide the fabric without causing any damage thereto.

Further according to the present invention, the movable spreading screw roller is forced into the space between the side screw rollers simultaneously with the contact of the movable guide roller with the stationary guide roller, when the inward deviation of the selvage of the fabric is detected, whereby the guiding function and the unfolding and spreading function can be improved synergically to render the fabric properly amenable to various treatments.

The present invention will be described below in greater detail with reference to the accompanying drawings, in which.

Figure 1:
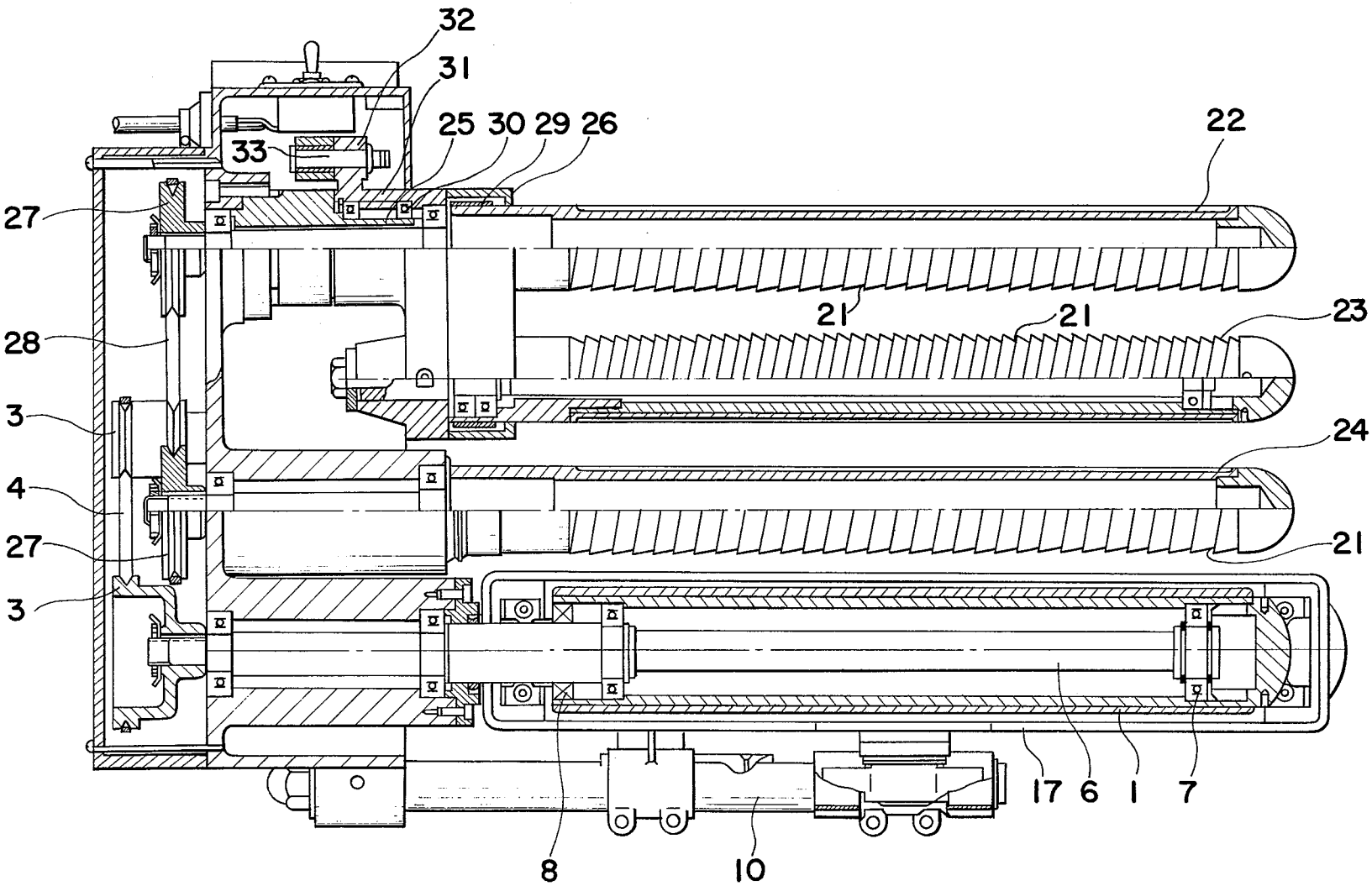
FIG. 1 is a front view showing the main part of the present apparatus in vertical section.
Figure 2:
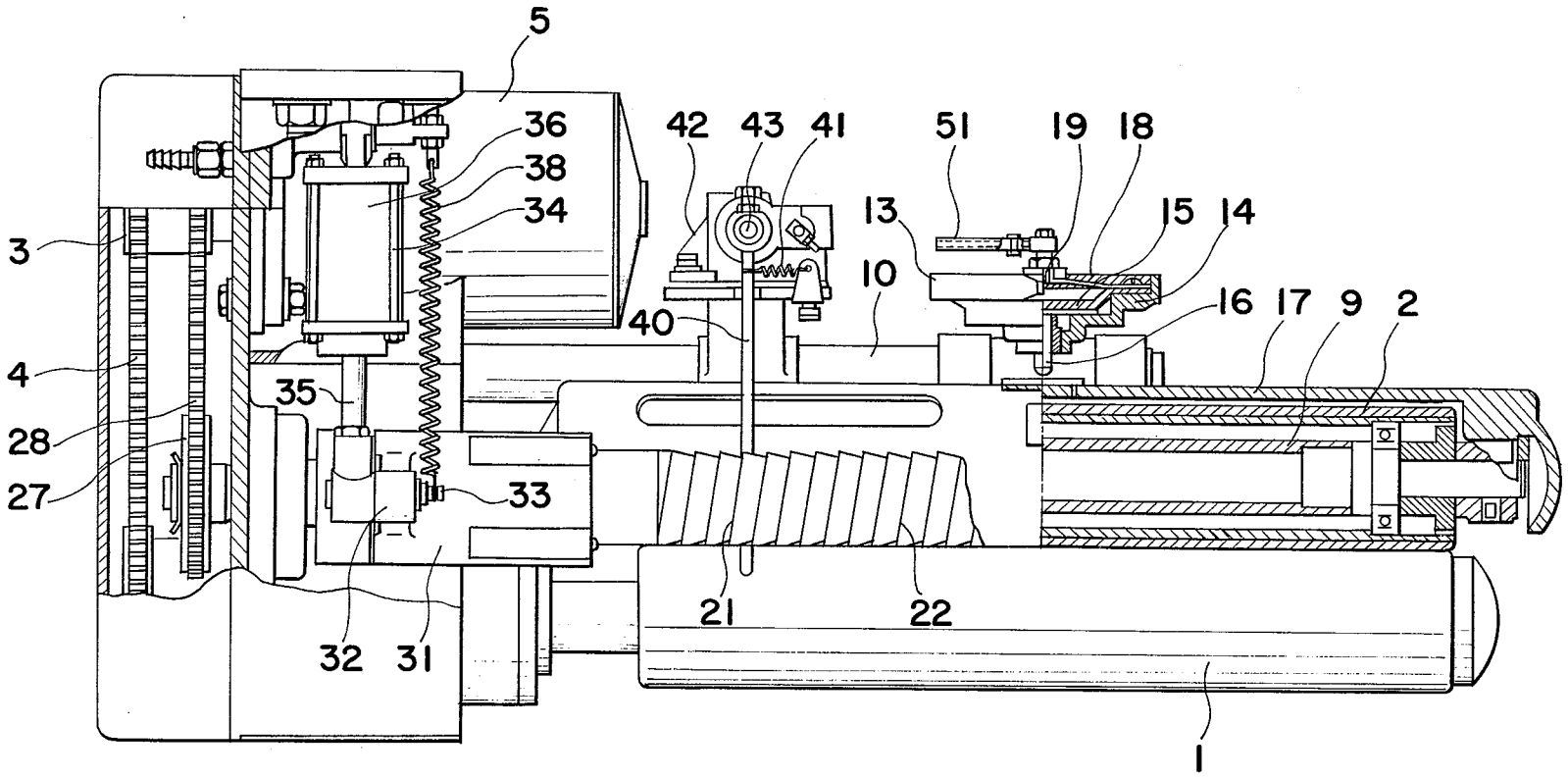
FIG. 2 is a fragmentary plan view partly in cross section showing the apparatus.
Figure 3:
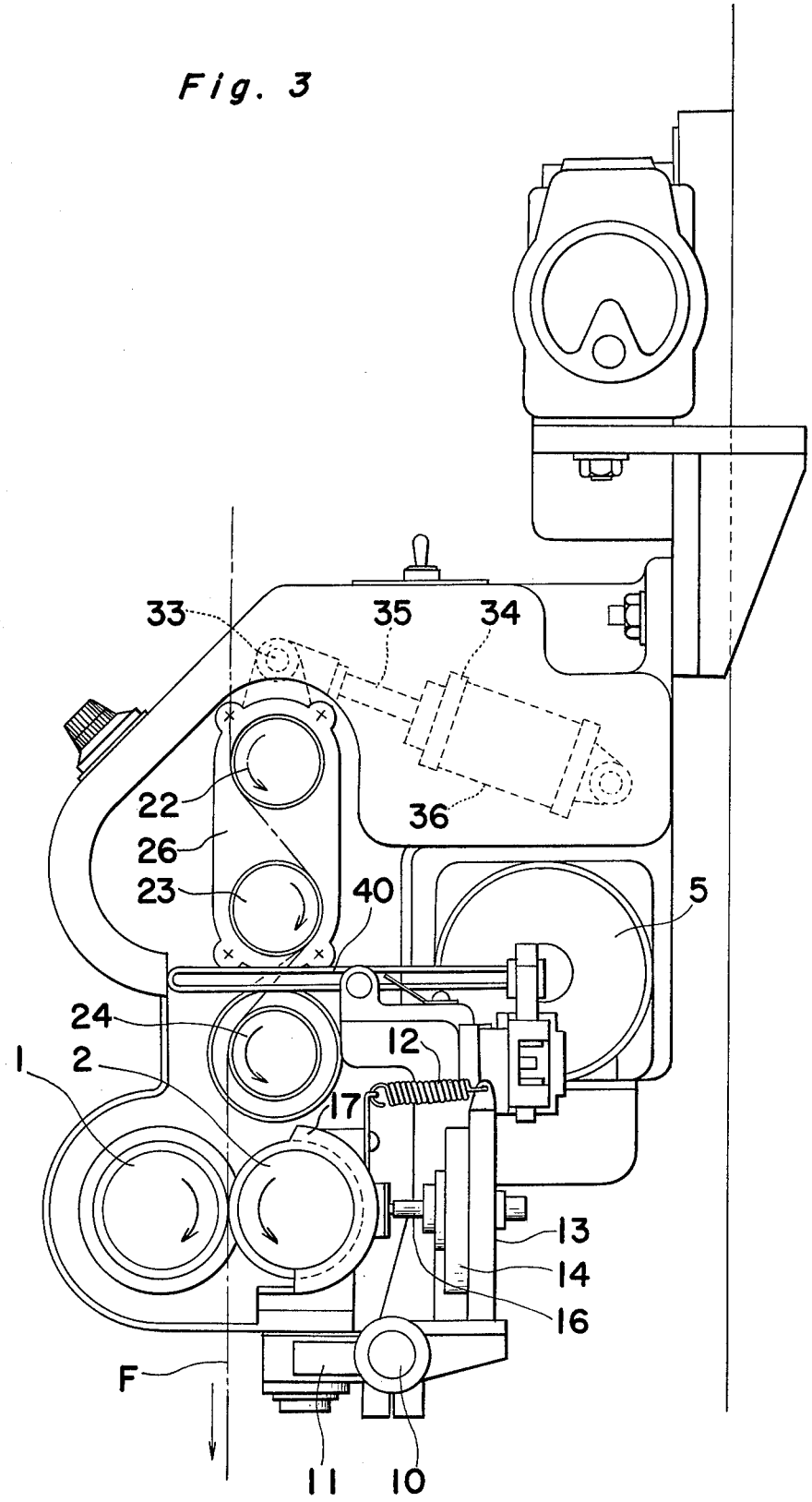
FIG. 3 is a fragmentary side elevation of the apparatus.
Figure 4:
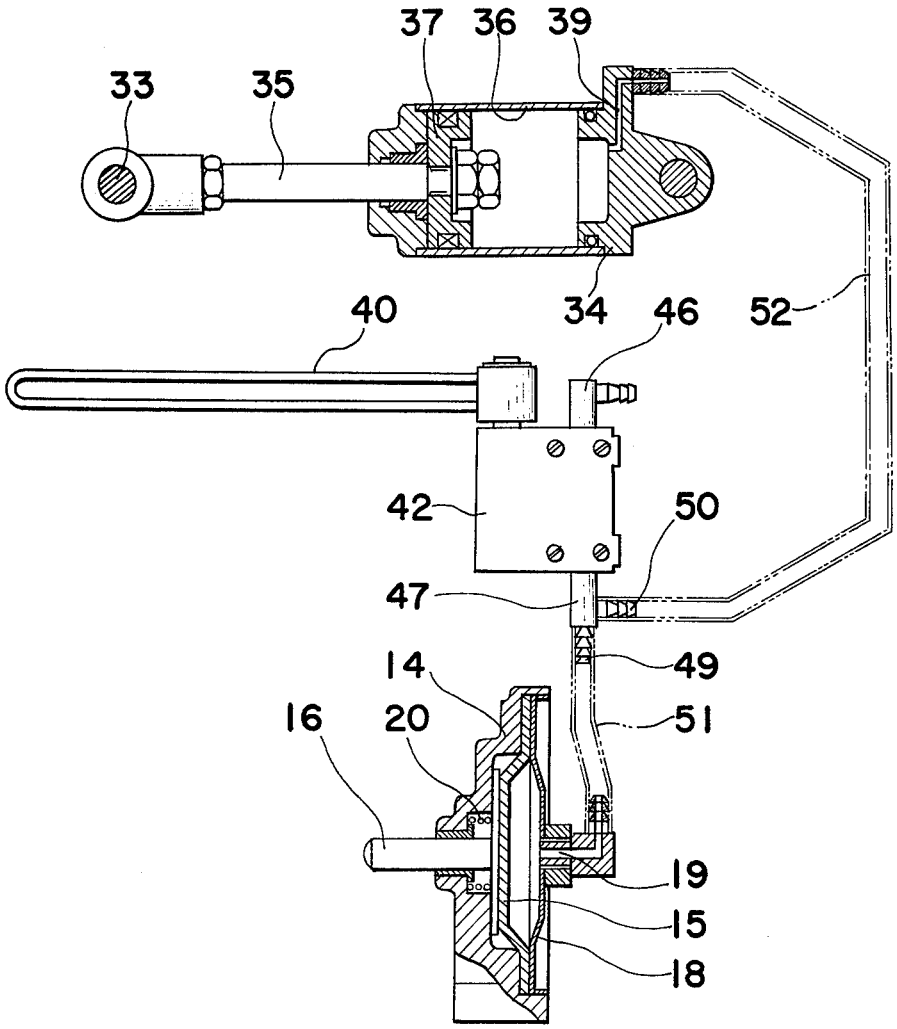
FIG. 4 is an enlarged view in section showing an air valve carrying a selvage sensor and connected to the means for moving the movable guide roller and to the shifting means for the movable unfolding and spreading screw roller.

With reference to FIGS. 1 to 3, the apparatus of this invention for unfolding, spreading and guiding a travelling fabric comprises the combination of guide means for correcting the deviation of the travelling fabric and properly guiding the fabric and unfolding and spreading means for remedying creasing and shrinkage of the fabric and turnups of its selvage.

The guide means comprises a stationary roller 1 and a movable roller 2 movable toward or away from the stationary roller 1 and opposed thereto. Urethane rubber or like rubber material provides the surfaces of the rollers 1 and 2. The stationary roller 1 is freely rotatably supported by bearings 7 on a shaft 6 which is positively driven by a motor 5 by way of pulleys 3 and a belt 4. An annular friction member 8 made of plastic, asbestos, metal or some other suitable material and having suitable frictional resistance is provided between the shaft 6 and the inner wall of the stationary roller 1 which is cylindrical. While the movable roller 2 is away from the stationary roller 1, the friction member 8 delivers the rotation of the shaft 6, rotating the roller 1 with the shaft 6. The movable roller 2, which is freely rotatably supported by a shaft 9, is pivotably connected by an arm 11 to a support rod 10 extending in parallel to the roller 2, the roller 2 being movable toward or away from the stationary roller 1 in parallel thereto. The roller 2 is spaced apart from the stationary roller 1 by a specified distance at all times by being biased by a coiled spring 12. However, when required, the movable roller 2 is forced toward the stationary roller 1 against the force of the spring 12 by a pusher assembly 13 for moving the roller 2. The pusher assembly 13 comprises a diaphragm body 14, a diaphragm 15 disposed in the body 14 and a push rod 16 secured to and supported by the center of the diaphragm 15. The projecting end of the push rod 16 bears against a roller cover 17 provided at one side of the roller 2 opposite to the stationary roller 1. A diaphragm cover 18 facing the diaphragm 15 has an inlet 19 for admitting air to the space therebetween. The diaphragm body 14 incorporates a coiled spring 20, which always urges the push rod 16 in the direction away from the movable roller 2.

The unfolding and spreading means comprises three screw rollers 22, 23 and 24 arranged at the feed side of the guide means and along the travelling direction of the fabric. Each of the screw rollers is formed in its surface with screw grooves 21 extending in the unfolding and spreading direction. The screw rollers 22 and 24 at the opposite sides are secured to the frame of the apparatus, while the intermediate screw roller 23 is connected to the stationary screw roller 22 by an arm 26 and is pivotally movable in a direction toward or away from the surface of the fabric about a shaft 25 at the base end of the roller 22. The three screw rollers 22, 23 and 24 are covered with urethane rubber or like rubber material and are positively driven by the motor 5 by means of pulleys 3, 27 and belts 28, 29 in the direction of unfolding and spreading the fabric. A collar 31 turnably covering the shaft 25 with bearings 30 interposed therebetween has an extension connected to the base portion of the movable screw roller 23 and a connecting portion 32 projecting outward at one side of the stationary screw roller 22. A piston-and-cylinder assembly 34 for shifting the movable screw roller 23 has a piston rod 35 whose projecting end is pivoted to the connecting portion 32 by a pin 33. The piston-and-cylinder assembly 34 comprises an air cylinder 36 and a piston 37 housed in the cylinder and having the piston rod 35. The piston 37 and rod 35 are biased at all times by a coiled spring 38 in the direction of their retraction, the spring 38 being attached at its one end to the projecting end of the pin 33. The air cylinder 36 has an air inlet 39.

A selvage sensor for sensing the position of the selvage of the travelling fabric comprises a touch lever 40 disposed at the feed side of the guide means in close proximity thereto. The touch lever 40 is connected at its base portion to the air valve 42 to be described below and is biased by a coiled spring 41 so as to turn inwardly of the proper position of the fabric selvage.

The air valve 42 comprises a turnable lever 45 having a bore 44 extending therethrough at its distal end and supported by a pivot 43 within a valve case and air conduits 46 and 47 arranged at the opposite sides of the lever 45 with the bore 44 positioned therebetween. The valve case has an air outlet 48 in the vicinity of the bore 44. The touch lever 40 is fixedly mounted at its base end on one end of the pivot 43 projecting from the valve case.

The air conduit 46 of the air valve 42 is connected to a suitable air compressor (not shown), while the other air conduit 47 has bifurcated ends 49 and 50. One end 49 is in communication with the air inlet 19 of the pusher 13 by way of an air hose 51, and the other end 50 communicates with the air inlet 39 of the piston-and-cylinder assembly 34 by an air hose 52.

The apparatus of this invention having the foregoing construction operates in the following manner to unfold, spread and guide the travelling fabric.

The present apparatus is disposed for each selvage of a travelling fabric strip F. Thus, a pair of the apparatus is used. As seen in FIG. 3, the selvage of the fabric is passed over the three unfolding and spreading screw rollers 22, 23 and 24 arranged side by side in such manner that the front and rear surfaces of the fabric are alternately in contact with the roller surfaces from roller to roller. More specifically, the fabric strip F is passed over the intermediate movable screw roller 23, with its one surface in contact with one side of the roller toward which the roller 23 will be forced when to be positioned between the other two rollers, the other surface of the fabric F being in contact with the opposite stationary screw rollers 22 and 24. The selvage of the fabric F is further passed between the pair of stationary guide roller 1 and the movable guide roller 2 and is then wound, for example, on an unillustrated take-up roller. The motor 5 rotates the screw rollers 22, 23 and 24 and the stationary guide roller 1 in the desired directions (e.g. in the directions indicated by the arrows in FIG. 3).

While travelling normally, the fabric F is always suitably spread by the screw rollers and passes between the stationary guide roller 1 and movable guide roller 2 which is spaced apart therefrom and is thereafter sent to the next process. However, if the fabric travels in a zigzag fashion or turnups, shrinkage or creasing occurs in the fabric for one cause or another, with the result that the selvage deviates from the proper position, the apparatus functions in the following manner and brings the selvage back to the proper position.

Figure 5:
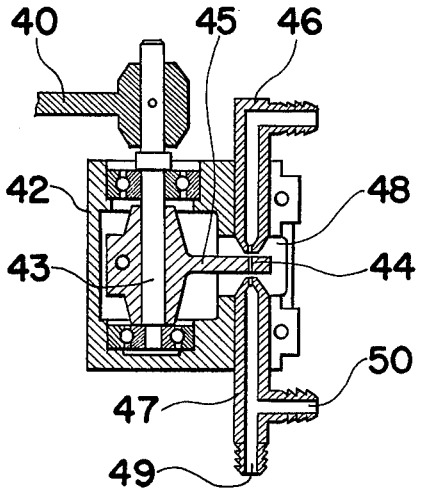
FIG. 5 is an enlarged view in section showing the air valve.

When the selvage of the fabric F deviates inward, the touch lever 40 is pulled inward by the coiled spring 41, turning the pivot 43 of the air valve 42 and the lever 45 and thereby bringing the bore 44 of the lever 45 into alignment with the opposed openings of the air conduit 46 and 47 of the air valve 42 as seen in FIG. 5. The air valve 42 is therefore opened, whereupon the compressed air from an air compressor flows through the air conduit 47, bifurcated ends 49, 50 and hoses 51, 52 into the pusher assembly 13 and into the piston-and-cylinder assembly 34. The compressed air supplied to the pusher assembly 13 flows from the inlet 19 into the space between the diaphragm cover 18 and the diaphragm 15, bulging the diaphragm 15 toward the movable guide roller 2 by its pressure and forcing out the push rod 16 against the coiled spring 20. The push rod 16 in turn pushes the movable roller 2 toward the stationary roller 1 against the coiled spring 12 and brings the two rollers 1 and 2 into contact with each other, causing the rollers 1 and 2 to nip the selvage of the fabric F and to guide the fabric outward to remedy the deviation as required.

On the other hand, the compressed air supplied to the piston-and-cylinder assembly 34 flows from the air inlet 39 into the air cylinder 36 and pushes the piston 37 with its air pressure, advancing the piston rod 35 against the coiled spring 38. Consequently, the piston rod 35 pivotally moves the collar 31 about the shaft 25, whereby the movable screw roller 23 connected to the extension of the collar 31 is brought into the space between the other two stationary rollers 22 and 24 to force the travelling fabric inward. This enables the fabric F to contact the screw rollers 22, 23 and 24 over increased areas and with an increased force, giving an improved unfolding and spreading effect.

Further if the selvage of the fabric F deviates outward toward the base portions of the rollers to excess, the selvage of the fabric F forces the touch lever 40 outward against the coiled spring 41, turning the lever 45 of the air valve 42 in the direction opposite to the previous direction to bring the bore 44 of the lever out of alignment with the openings of the air conduits 46 and 47, whereupon the air valve 42 is closed, interrupting the supply of the compressed air to the pusher assembly 13 and the piston-and-rod assembly 34. Consequently, the bulged diaphragm 15 of the pusher assembly 13 restores itself under the action of the coiled spring 20, retracting the push rod 16 and allowing the coiled spring 12 to move the movable roller 2 away from the stationary roller 1. Thus, the fabric F is brought out of nipping engagement with the two rollers 1 and 2, whereupon the outward guiding action given to the fabric discontinues. At the same time, the coiled spring 38 retracts the piston 37 of the assembly 34 along with the piston rod 35, turning the collar 31 in the direction opposite to the foregoing direction and accordingly bringing the movable screw roller 34 out of the space between the other two stationary screw rollers 22 and 24. This reduces the amount of the fabric F pushed inward, allowing the fabric F to contact the screw rollers 22, 23 and 24 over reduced areas and with a reduced force and permitting the screw rollers to give the appropriate unfolding and spreading action initially afforded.

With the apparatus of this invention having the foregoing construction, the travelling fabric F is always subjected to a suitable unfolding and spreading action by the three screw rollers 22, 23 and 24 which are driven by the motor 5, whereby creasing and shrinkage of the fabric and turnups of its selvage, if any, can be remedied. Further when the selvage deviates inward for some cause, the movable screw roller 23 is brought into the space between the opposite end screw rollers 22 and 24 to give a greater unfolding and spreading effect and, at the same time, the stationary guide roller 1 and movable guide roller 2 are brought into nipping engagement with the selvage to guide the fabric to the proper position. In this way, the present apparatus performs the function of unfolding and spreading and the function of guiding at the same time with synergically improved results.

The present apparatus is further characterized by the friction member 8 having suitable frictional resistance and provided between the shaft 6 which is positively rotatable by the motor 5 and the cylindrical roller 1 loosely mounted on the shaft 6. The friction member 8 causes the stationary roller 1 to rotate with the shaft 6 when the movable roller 2 is away from the stationary roller 1. However, when the stationary and movable rollers 1 and 2 remedy the deviation of the fabric F in nipping engagement therewith, the travelling fabric drives the stationary roller 1 therewith while overcoming the frictional resistance of the friction member 8. As a result, the rollers will not give any tension to the fabric or slacken the fabric when nipping the fabric. The rollers can remedy the deviation of the fabric very smoothly without causing the damage thereto.

Further because the travelling fabric passes over the three screw rollers 22, 23 and 24 in such manner that the front and rear surfaces of the fabric are alternately in contact with the roller surfaces from one roller to another, turnups on both the front and rear surfaces, if any, can be eliminated.

Although this invention has been described above with reference to an embodiment for illustrative purposes, the invention is not limited to the embodiment but can be modified variously by one skilled in the art. Such modifications are to be included within this invention insofar as they do not depart from the scope of the invention as defined by the appended claims.

I claim:

1. An apparatus for unfolding, spreading and guiding a travelling fabric comprising for each selvage of the fabric guide means including a stationary roller and a movable roller opposed to the stationary roller and movable toward or away therefrom to nip a selvage of the fabric between the rollers when required to correct deviation of the fabric, unfolding and spreading means including at least three screw rollers arranged side by side at the feed side of the guide means and along the direction of travel of the fabric, each of the screw rollers being rotatable by a motor in the direction of unfolding and spreading the fabric, at least one of the screw rollers other than the screw rollers at the opposite sides thereof being pivotally movable in a direction toward or away from the surface of the fabric when required, the stationary roller of the guide means having a roller main body and a shaft rotatable by the motor in the same direction as the direction of travel of the fabric, a friction member provided between the shaft and the stationary roller main body and having suitable frictional resistance to render the stationary roller main body rotatable by the motor when the movable roller is away from the stationary roller, a selvage sensor disposed for the selvage of the fabric, means for moving the movable guide roller into contact with the stationary guide roller upon the sensor detecting inward deviation of the selvage of the fabric, and shifting means for forcing the movable screw roller into the space between the screw rollers on the opposite sides thereof simultaneously with the contact of the movable guide roller with the stationary guide roller upon the sensor detecting the inward deviation of the selvage.

2. An apparatus as defined in claim 1 wherein the surface of each of the stationary roller and movable roller of the guide means and the surface of each of the screw rollers are provided by a rubber material.

3. An apparatus as defined in claim 1 wherein the intermediate screw roller is rotatable in a direction opposite to the direction of rotation of the screw rollers at the opposite sides thereof.

4. An apparatus as defined in claim 1 wherein the friction member provided between the stationary roller main body and the roller shaft is in the form of a ring.

5. An apparatus as defined in claim 1 wherein the selvage sensor comprises a touch lever.

6. An apparatus as defined in claim 1 wherein the means for moving the movable roller of the guide means comprises a diaphragm body, a diaphragm disposed in the body, a push rod secured to the diaphragm and having a projecting end bearing against a rear portion of the movable roller and a coiled spring urging the push rod away from the movable roller at all times.

7. An apparatus as defined in claim 1 wherein the shifting means for the pivotally movable screw roller comprises an air cylinder having a piston rod and a coiled spring urging the piston rod in its returning direction at all times, the piston rod having a projecting end pivoted to a support for the pivotally movable screw roller.

8. An apparatus as defined in claim 1 wherein the movable roller of the guide means is urged by a coiled spring away from the stationary roller at all times.

9. An apparatus as defined in claim 1 wherein the means for moving the movable roller of the guide means and shifting means for the pivotally movable screw roller are simultaneously initiated into movement with compressed air via an air valve provided commonly for the two means upon the selvage sensor detecting the inward deviation of the selvage.

* * * * *